US006991352B2

(12) United States Patent
Garber et al.

(10) Patent No.: US 6,991,352 B2
(45) Date of Patent: Jan. 31, 2006

(54) LIGHT FIXTURE HAVING A SUPPORT SYSTEM

(75) Inventors: Thomas A. Garber, Mount Pleasant, SC (US); Gregory H. Winch, Mount Pleasant, SC (US)

(73) Assignee: Quoizel, Inc., Goose Creek, SC (US)

( * ) Notice: Subject to any disclaimer, the term of this patent is extended or adjusted under 35 U.S.C. 154(b) by 51 days.

(21) Appl. No.: 10/426,912

(22) Filed: Apr. 30, 2003

(65) Prior Publication Data

US 2004/0218396 A1 Nov. 4, 2004

(51) Int. Cl.
*F21V 21/00* (2006.01)
*B42F 13/04* (2006.01)

(52) U.S. Cl. ..... 362/396; 362/432; 362/147; 248/343

(58) Field of Classification Search ..... 362/432, 362/396, 368, 365, 364, 147; 248/343
See application file for complete search history.

(56) References Cited

U.S. PATENT DOCUMENTS

| | | | | | |
|---|---|---|---|---|---|
| 1,834,795 | A | * | 12/1931 | Morse | 174/62 |
| 4,199,803 | A | * | 4/1980 | Hunt, III | 362/263 |
| 5,434,356 | A | * | 7/1995 | Zekowski | 174/48 |
| 5,560,101 | A | * | 10/1996 | Sandell et al. | 29/868 |
| 6,595,664 | B2 | | 7/2003 | Bucher et al. | |
| 6,619,919 | B2 | * | 9/2003 | Kerr, Jr. | 416/5 |
| 2003/0147749 | A1 | | 8/2003 | Kerr, Jr. | |

OTHER PUBLICATIONS

UL 1598, pp. tr1, tr2, and sections 7.1, 7.2, 7.5 and 13.15 (2000).

* cited by examiner

*Primary Examiner*—Ali Alavi
(74) *Attorney, Agent, or Firm*—Nelson Mullins Riley & Scarborough

(57) ABSTRACT

A light fixture having a support system for holding the light fixture during installation, thereby allowing the user to have both hands free for wiring. The system includes a bracket configured to be mounted to an electrical box. A tether extends from the light fixture and has a connecting element for releasably attaching the tether to the bracket.

16 Claims, 4 Drawing Sheets

LIGHT FIXTURE HAVING A SUPPORT SYSTEM

BACKGROUND OF THE INVENTION

The present invention generally relates to light fixtures. More particularly, the invention relates to light fixtures containing a support system to facilitate installation.

Light fixtures are typically mounted to an electrical outlet box which is flush mounted to a surface, such as a wall or ceiling. (As used herein, the term "flush mounted" means that the outlet box is mounted at or behind the surface in the conventional manner without necessarily being perfectly flush). Prior to mounting, however, the light fixture must be electrically connected to wires located in the outlet box. While attempting to connect the wires of the light fixture to those of the outlet box, the user must also support the light fixture. If the user installs the light fixture alone, one hand must be used to connect the wires while the other hand holds the light fixture. This can be awkward and difficult.

Moreover, certain light fixtures cannot be installed alone. For example, heavy or large light fixtures may require one person to hold the light fixture while another person connects the wires. Therefore, there is a need for a novel mounting arrangement that facilitates installation of a light fixture.

SUMMARY OF THE INVENTION

In one aspect, the present invention provides a light fixture mounting assembly. The assembly includes a bracket configured to be attached to an electrical outlet box and a light fixture. A tether is provided with a first end connected to the light fixture. The tether has a second end being releasably attachable to the bracket.

In another aspect, the present invention provides a light fixture mounting assembly with a bracket configured to be mounted to an electrical outlet box and a light fixture for mounting to a surface. The bracket has a configured connection opening with a first portion and a second portion. A tether is provided with a first end connected to the light fixture. The tether has a second end with a connecting element dimensioned to pass through the first portion, but unable to pass through the second portion.

In another aspect, the present invention provides a bracket for mounting a light fixture with a connecting tether. The bracket has a support member configured for attachment to an electrical outlet box. The support member also has a configured connection opening which is adapted to receive the connecting tether. A mounting member is provided which is substantially perpendicular to the support member and has anchors for securing the light fixture.

In another aspect, the present invention provides an apparatus having a bracket configured to be mounted to an electrical outlet box. A light fixture adapted to support a light source is also provided. The apparatus also includes a tether for releasably attaching the light fixture to the bracket and supporting the weight of the light fixture during connection of wires.

In another aspect, the present invention provides a method for mounting a light fixture. A bracket is mounted to an electrical outlet box. A releasable tether is extended between the light fixture and the bracket so that the tether supports the weight of the light fixture. Wires of the light fixture are then electrically connected to wires of the electrical outlet box. The light fixture is then mounted to the bracket such that the light fixture will be mounted to the surface.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
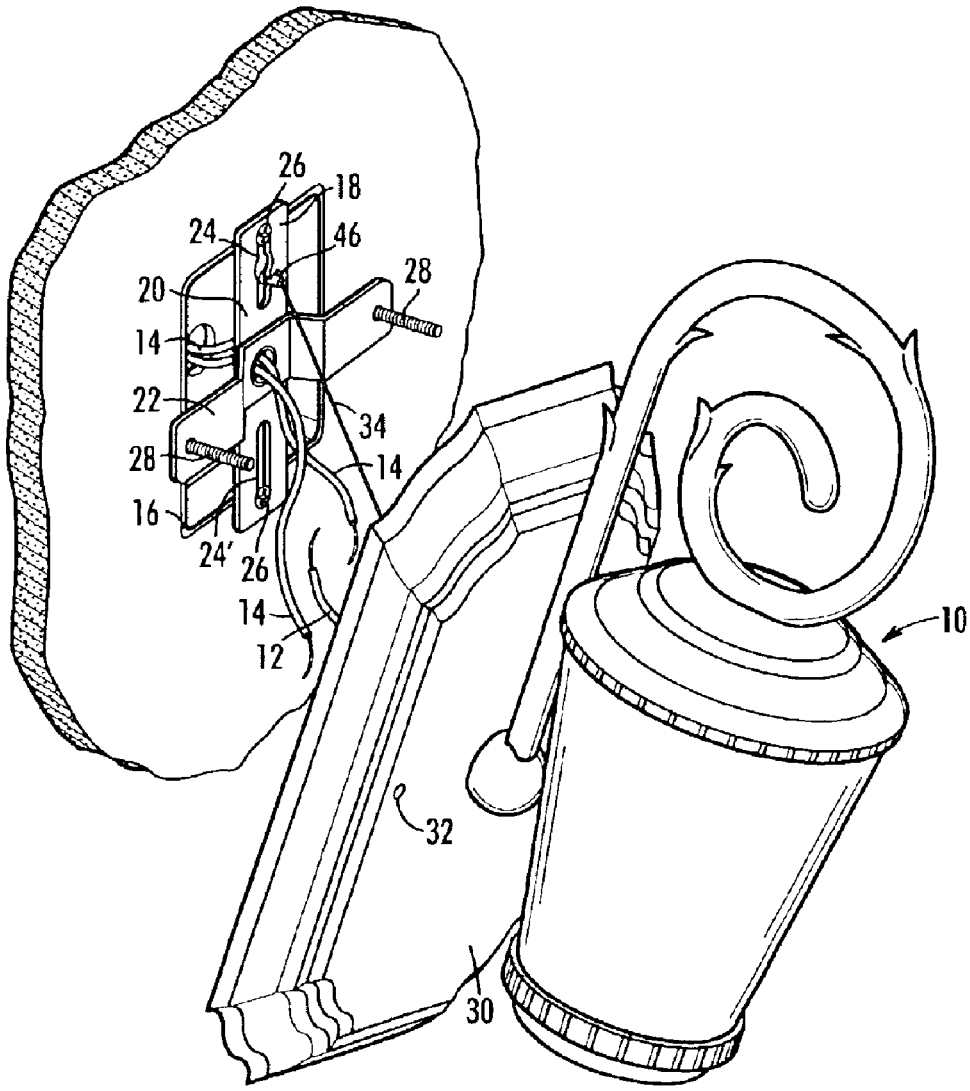
FIG. 1 is a perspective view of a light fixture which is being supported during installation onto a wall in accordance with the present invention.

Repeat use of reference characters in the present specification and drawings is intended to represent same or analogous features or elements of the invention.

DETAILED DESCRIPTION

It is to be understood by one of ordinary skill in the art that the present discussion is a description of exemplary embodiments only and is not intended as limiting the broader aspects of the present invention, which broader aspects are embodied in the exemplary constructions.

Figure 2:
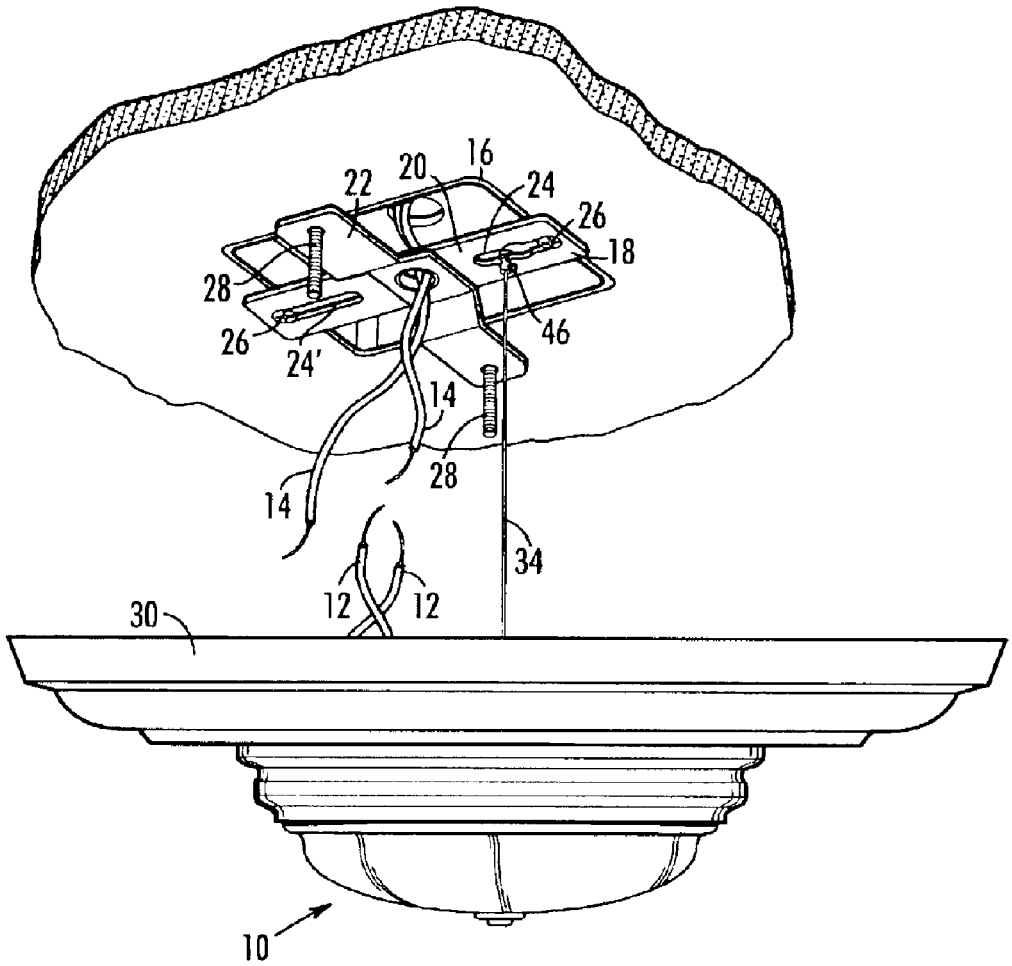
FIG. 2 is a perspective view of a light fixture which is being supported during installation onto a ceiling in accordance with the present invention.

Referring now to FIGS. 1 and 2, a light fixture 10 according to the present invention may be supported during installation so that an installer may use both hands to connect wires. Light fixture 10 contains a light source (not shown) which may be connected to a source of electrical power. For example, light fixture 10 has wires 12 which may be electrically connected to wires 14 located within an electrical outlet box 16.

As is typical, light fixture 10 is mounted using a bracket 18 attached to outlet box 16. Bracket 18 includes a support member 20 which is fixed perpendicularly to a mounting member 22. Support member 20 defines slots 24 and 24' which are dimensioned to receive screws 26 or other suitable fasteners for attaching support member 20 to outlet box 16.

Figure 4:
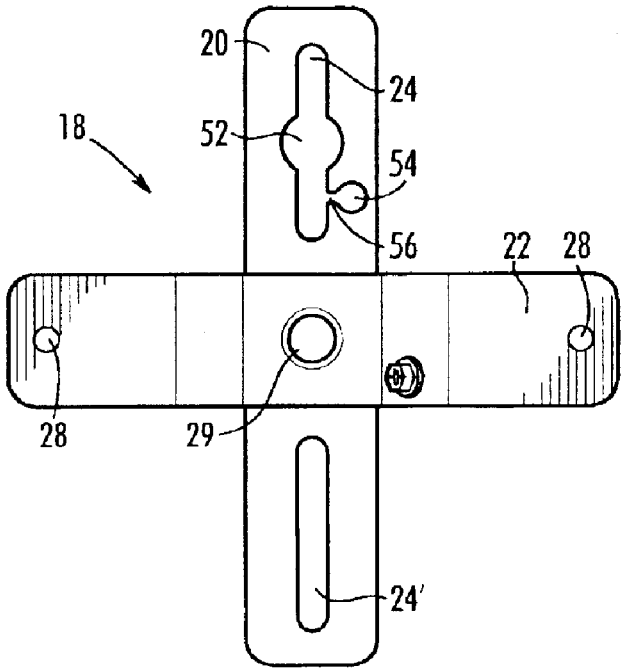
FIG. 4 is a front elevation view of a bracket constructed according to the present invention.

For securing light fixture 10, mounting member 22 includes threaded anchors 28. For example, light fixture 10 may include a mounting plate 30 with holes 32 dimensioned to receive anchors 28. Bracket 18 has a central hole 29 (FIG. 4) to allow electrical wires 14 to pass therethrough. It should be appreciated that support member 20 and mounting member 22 can be constructed as a unitary member or can be two pieces directly connected. In one embodiment, support member 20 and mounting member 22 are rotatable with respect to one another through a limited angular range. One of ordinary skill in the art should-recognize that light fixture 10 could be mounted vertically (FIG. 1), horizontally (FIG. 2) or to another suitable mounting surface.

Figure 3:
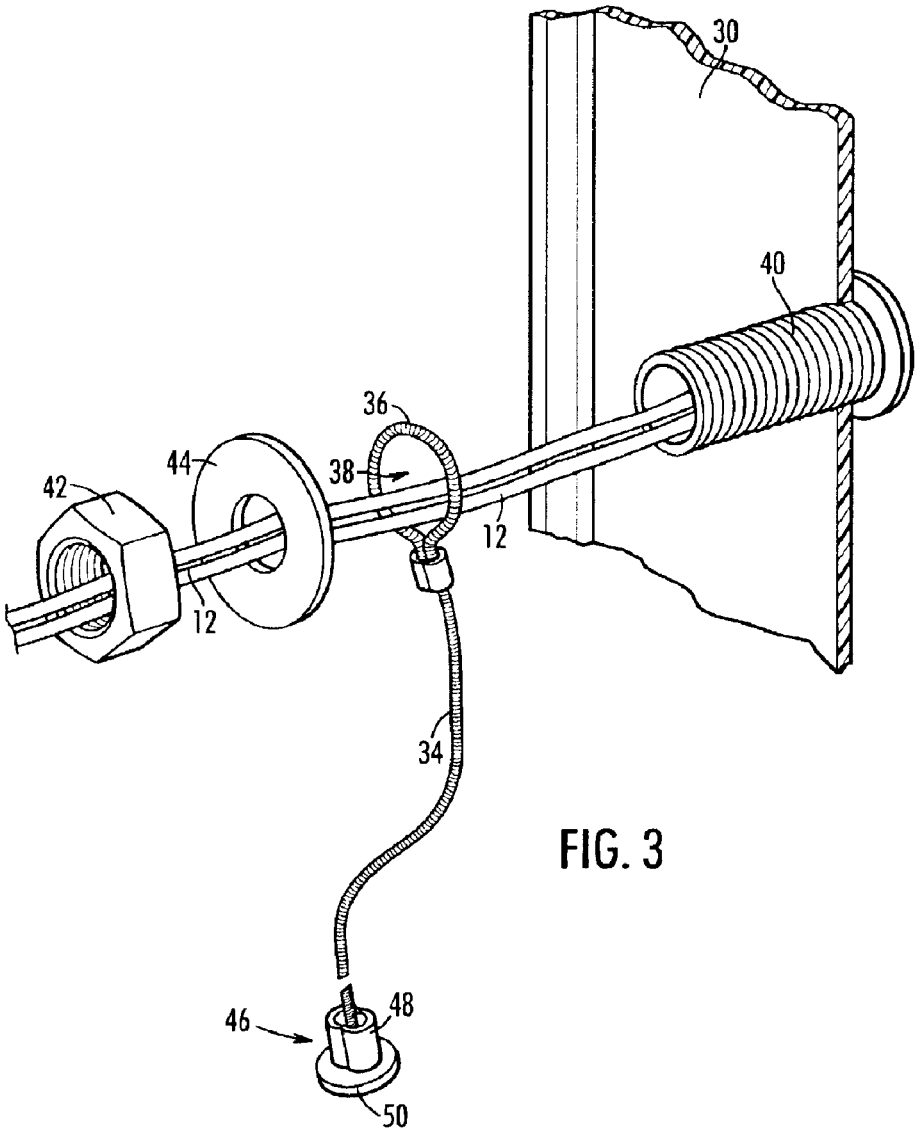
FIG. 3 is an enlarged rear exploded view showing a portion of the light fixture of FIG. 1 to illustrate one manner in which the tether may be attached thereto.

Referring now also to FIG. 3, a tether 34 extends from the back of light fixture 10. In one embodiment, tether 34 is formed of a braided metal wire. In any event, tether 34 will preferably have sufficient tensile strength to support the weight of light fixture 10.

In the illustrated embodiments, tether 34 has a first end suitably secured to mounting plate 30 of light fixture 10. For example, tether 34 may have a loop 36 with an opening 38 dimensioned to be received by a threaded stud 40 in the back of light fixture 10. A nut 42 and washer 44 may then be attached to threaded stud 40 to secure tether 34 to the back of light fixture 10. In this embodiment, stud 40 is hollow such that wires 12 can pass therethrough as shown.

Figure 5:
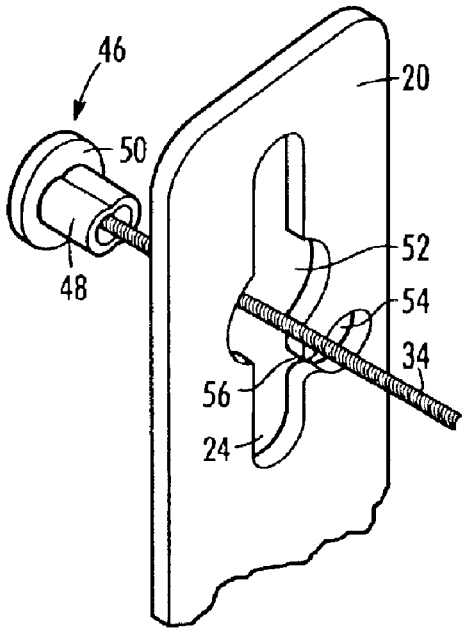
FIG. 5 is an enlarged perspective view of the connecting element of the tether passing through the first portion of the connection opening of the bracket of FIG. 4.
Figure 6:
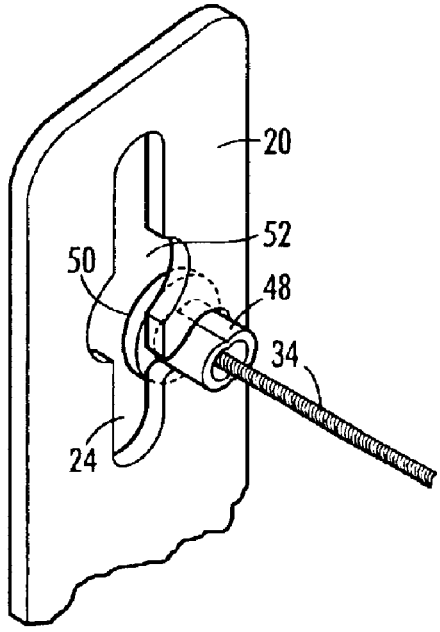
FIG. 6 is a detailed perspective view of the connecting element of the tether held within the second portion of the connection opening of the bracket of FIG. 4.

Tether 34 has a connecting element 46 on its opposite end. As shown in FIGS. 1 and 2, connecting element 46 of tether 34 can temporarily support light fixture 10 during the installation process. In one embodiment (illustrated in FIGS. 5–6), connecting element 46,has a cylindrical portion 48 and a flange 50. Slot 24 defines a configured connection opening having a first portion 52 and a second portion 54 with a reduced width channel 56 therebetween. Channel 56 is dimensioned to allow tether 34 to pass between first portion 52 and second portion 54. First portion 52 is dimensioned to allow flange 50 of connecting portion 46 to pass therethrough. Second portion 54 is dimensioned to receive cylindrical portion 48, but to prevent flange 50 from passing therethrough (as best shown in FIG. 6). Thus, an interference fit is formed between support member 20 and connecting portion 46.

With connecting element 46 secured to bracket 18, the weight of light fixture 10 is supported by bracket 18, without requiring a user to hold light fixture 10 while connecting wires 12 and 14. Thus, installation of light fixture 10 is facilitated. Moreover, light fixture 10 may be installed by a single person, without requiring one person to hold light fixture 10 while another person connects wires 12 and 14.

It should be appreciated by one of ordinary skill in the art that other suitable connections could be formed between bracket 18 and tether 34. For example, tether 34 could have an end with an eyelet that may be received by a knob in bracket 18. By way of another example, tether 34 could be releasably secured to bracket 18 using a bayonet connection.

During installation of light fixture 10, bracket 18 is mounted to outlet box 16 using screws 26. Connecting element 46 of tether 34 is then placed through first portion 52 (FIG. 5) and moved so that cylindrical portion 48 of connecting element 46 is received by second portion 54 (FIG. 6). Since light fixture 10 is supported by tether 34, the user is not required to hold light fixture 10 while connecting wires 12 and 14. Thus, the user may use both hands to connect wires 12 and 14 between light fixture 10 and outlet box 16. With light fixture 10 electrically connected to a source of power, mounting plate 30 may be secured to mounting member 22 by placing holes 32 through anchors 28 and fastening in place. Decorative nuts are often utilized for this purpose, as one skilled in the art will appreciate.

One of ordinary skill in the art should also appreciate that light fixture 10 could be constructed in various styles without departing from the scope of the present invention. Moreover, it should be understood that aspects of various embodiments may be interchanged both in whole or in part. Furthermore, those of ordinary skill in the art will appreciate that the foregoing description is by way of example only, and is not intended to be limitative of the invention so further described in the appended claims.

What is claimed is:

1. A light fixture mounting assembly comprising:

a bracket configured to be attached to an electrical outlet box;

a light fixture;

a tether having a first end and a second end, said first end being connected to said light fixture and said second end being releasably attachable to said brackets;

wherein said bracket defines a configured connection opening having a first portion and a second portion with a reduced-width channel therebetween, said reduced-width channel being dimensioned smaller than said first portion and said second portion to allow said tether to pass between said first portion and said second portion; and said tether has an enlarged connecting element attached to said second end, said first portion of said configured connection opening being dimensioned to allow said connecting element to pass therethrough.

2. The assembly as recited in claim 1, wherein said bracket includes a support member configured to be attached to said electrical outlet box and a mounting member configured to be attached to said light fixture.

3. The assembly as recited in claim 2, wherein said bracket is configured such that said support member is substantially perpendicular to said mounting member.

4. The assembly as recited in claim 1, wherein said second portion is dimensioned to prevent said connecting element from passing therethrough.

5. The assembly as recited in claim 1, wherein said first portion of said configured connection opening is part of an elongate slot for attaching said bracket to said electrical outlet box.

6. The assembly as recited in claim 1, wherein said tether has an enlarged connecting element attached to said second end, said connecting element having a flange dimensioned to pass through said first portion, but unable to pass through said second portion.

7. The assembly as recited in claim 1, wherein said connecting element and said bracket are releasably attached by an interference fit.

8. The assembly as recited in claim 1, wherein said tether is formed of braided metal wire.

9. A light fixture mounting assembly comprising:

a bracket configured to be mounted to an electrical outlet box, said bracket defining a configured connection opening having a first portion and a second portion, said first portion of said configured connection opening being part of an elongated slot for attaching said bracket to said electrical outlet box;

a light fixture for mounting to a surface; and a tether having a first end connected to said light fixture, said tether further having a second end including a connecting element dimensioned to pass through said first portion, but unable to pass through said second portion.

10. The assembly as recited in claim 9, wherein said bracket includes a support member configured to be attached to said electrical outlet box and a mounting member configured to be attached to said light fixture.

11. The assembly as recited in claim 10, wherein said configured connection opening is defined in said support member.

12. The assembly as recited in claim 9, wherein said tether has sufficient tensile strength to support the weight of said light fixture frame.

13. The assembly as recited in claim 9, wherein said bracket further defines a second elongated slot for attaching said bracket to said electrical outlet box.

14. A bracket for mounting a light fixture having a connecting tether, said bracket comprising:

a support member configured for attachment to an electrical outlet box, said support member having a configured connection opening adapted to receive the connecting tether;

a mounting member substantially perpendicular to said support member, said mounting member having anchors for securing the light fixture, said anchors being elongated threaded members; and wherein said support member and said mounting member are rotatable with respect to one another through a limited angular range.

15. The bracket as recited in claim 14, said configured connection opening defines a first portion and a second portion with a reduced-width channel therebetween, said channel being dimensioned to allow said tether to pass between said first portion and said second portion.

16. The bracket as recited in claim 14, further defining a central hole for passage of electrical wires therethrough located where said support member and said mounting member intersect.

* * * * *